US007013724B2

(12) United States Patent
Chikin

(10) Patent No.: US 7,013,724 B2
(45) Date of Patent: Mar. 21, 2006

(54) METHOD FOR CHARACTERIZING PARAMETERS OF WELLS, WELL BOTTOM ZONE AND FORMATION, AND DEVICE FOR CARRYING OUT SAID METHOD

(76) Inventor: Andrey Yegorovich Chikin, Tovarischeskiy per. d. 29, korpus 2, Moscow (RU) 109004

( * ) Notice: Subject to any disclaimer, the term of this patent is extended or adjusted under 35 U.S.C. 154(b) by 123 days.

(21) Appl. No.: 10/311,351

(22) PCT Filed: Apr. 30, 2002

(86) PCT No.: PCT/RU02/00212

§ 371 (c)(1),
(2), (4) Date: Jan. 7, 2003

(87) PCT Pub. No.: WO02/090716

PCT Pub. Date: Nov. 14, 2002

(65) Prior Publication Data

US 2003/0173079 A1 Sep. 18, 2003

(30) Foreign Application Priority Data

May 8, 2001 (RU) ..... 2001112187

(51) Int. Cl.
*E21B 49/00* (2006.01)

(52) U.S. Cl. ..... 73/152.41; 73/152.39; 73/152.46

(58) Field of Classification Search ..... 73/152.41, 73/152.39, 152.46
See application file for complete search history.

(56) References Cited

U.S. PATENT DOCUMENTS 4,414,846 A 11/1983 Dublin, Jr.
4,424,859 A * 1/1984 Sims et al. ..... 166/67
5,890,549 A * 4/1999 Sprehe ..... 175/71

FOREIGN PATENT DOCUMENTS

| | | |
|---|---|---|
| GB | 2235540 | 3/1991 |
| RU | 1469110 | 3/1989 |
| RU | 2151855 | 6/2000 |
| RU | 2151856 | 6/2000 |
| RU | 2151859 | 6/2000 |
| SU | 2055984 | 3/1996 |

* cited by examiner

*Primary Examiner*—Hezron Williams
*Assistant Examiner*—André K. Jackson
(74) *Attorney, Agent, or Firm*—Jacobson Holman PLLC

(57) ABSTRACT

The invention is related to the oil industry and can be used in well intake capacity testing and well bottom zone treatment.

Figure 1:
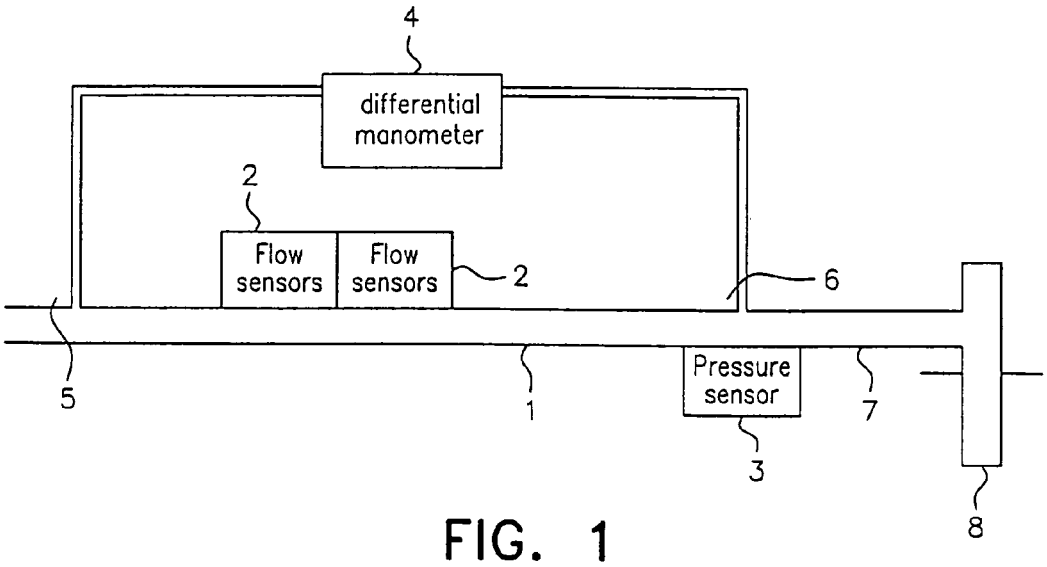

On injection line in front of the wellhead it is set a measuring section of a length allowing to fix pressure drops when flow medium of minimum hydraulic friction flowing. The section is in the form of a calibrated pipe with assembled flow sensors, a pressure sensor and an additional differential manometer with impulsive pipes connected with the start and the end of the measuring section. The following operations are conducted. An impulsive non-stationary formation water injection, the injection pressure and flow rate measurements at wellhead, recalculation of the data to the bottom hole conditions, determination of the stored flow rate and the work required for a non-steady state flow of the agent consumption unit in a well bottom zone. Skin-effect coefficient is calculated by these figures, taking into account the current conductivity of a bed, the latter is determined by the results of short-time impulsive non-stationary well intake capacity testing. The method also includes changing of the agent injection mode when the well bottom zone filtration characteristics required are achieved and determined by the skin-effect calculated by the stored flow rate and the agent flow consumption unit work in a well bottom zone, taking into account the current conductivity of a bed.

To determine a water permeability, piezoconductivity and radius of a well bottom zone and skin-effect coefficient, a repression function is determined for every gaging in conditions of non-stationary formation water injection during every injection mode, the function characterizes a non-stationary flow in a well bottom zone during the given fluid injection mode. The method also includes a construction of the repression function-logarithm of injection time diagram, highlighting of initial sloping straights on every diagram obtained, finding of parameters of highlighted straights by the least-squares method, by which it is possible to determine a water permeability and piezoconductivity of polluted bottomhole formation zone, as well as its radius and skin-effect coefficient.

To determine a water permeability of producing formation, a stored flow rate and repression function, characterizing the work required for a non-steady state flow of the formation water consumption unit are determined, as well as construction of the repression derived function-stored flow rate diagram for bed water permeability range, a fortiori including the desired bed water permeability and a possibility of choice among a great number of curves of derived line, which is in nearby conformity with the derived function constancy condition is made. The derived function corresponds to the desired water permeability of bed.

4 Claims, 6 Drawing Sheets

METHOD FOR CHARACTERIZING PARAMETERS OF WELLS, WELL BOTTOM ZONE AND FORMATION, AND DEVICE FOR CARRYING OUT SAID METHOD

This is a nationalization of PCT/RU02/00212, filed Apr. 30, 2002 and published in Russian.

The invention is related to the oil industry and can be used in well intake capacity testing and well bottom zone treatment.

It is known a producing formation development method. This method includes impulsive non-stationary formation water injection, injection pressure and flow rate measurements at wellhead, determination of a stored flow rate and repression derived function, characterizing the work required for non-steady state flow of formation water consumption unit, construction of a repression derived function-stored flow rate diagram for a bed water permeability range, a fortiori including the desired bed water permeability and a possibility of choice among a great number of curves of derived line, which is in nearby conformity with the derived function constancy condition. The derived function corresponds to the desired water permeability of bed. (Patent # 2151859 of the Russian Federation, E class 21 B 43/20, published in 2000).

It is known a method of well operation with simultaneous determination of polluted well bottom zone parameters. This method includes non-stationary formation water injection with step changes in flow rate from minimum to maximum. Measuring period is specified—pressure, density and flow rate are recorded in every 5–60 s. This method also includes recalculation of the data to the bottom hole conditions, repression function determination for every gaging in conditions of non-stationary formation water injection during every injection mode, the function characterizes non-stationary flow in a well bottom zone during the given fluid injection mode. The method also includes a construction of the repression function-logarithm of injection time diagram, highlighting of initial sloping straights on every diagram obtained, finding the parameters of highlighted straights by the least-squares method by which it is possible to determine a water permeability and piezoconductivity of polluted bottomhole formation zone, as well as its radius and skin-effect coefficient (Patent # 2151856 of the published in 2000).

The known methods have the following common defects: low quantity of parameters being measured, a low accuracy and effectiveness of bottom-hole pressure determination when injecting fluids of difficult rhelogy and difficulties in well potential determination.

A method of well operation, during implementation of which it becomes possible to determine well, bottom hole formation zone and bed characteristics, is technically close to the invention. The method includes impulsive non-stationary formation water injection, injection pressure and flow rate measurements at wellhead, recalculation of the data to the bottom hole conditions, determination of stored flow rate and the work required for non-steady state flow of the agent consumption unit in a well bottom zone. Skin-effect coefficient is calculated by these figures, taking into account the current conductivity of a bed, the latter is determined by the results of a short-time impulsive non-stationary well intake capacity testing. The method also includes the changing of agent injection mode when well bottom zone filtration characteristics required are achieved and determined by the skin-effect calculated by the stored flow rate and the agent flow consumption unit work in well bottom zone, taking into account the current conductivity of bed. (Patent # 2151855 of the Russian Federation, E class 21 B 43/20, published in 2000—prototype).

The known method has the following shortcomings: low quantity of parameters being measured and low accuracy of well, bottomhole formation zone and bed characteristics determination.

This invention solves the problem in increasing the number of parameters being measured and improving of well, bottomhole formation zone and bed characteristics determination accuracy.

The problem is solved in the following way: in the method (including impulsive non-stationary formation water injection, injection pressure wellhead, recalculation of the data to the bottom hole conditions, determination of stored flow rate and the work required for non-steady state flow of the agent consumption unit. Skin-effect coefficient is calculated by these figures taking into account the current conductivity of bed, the latter is determined by the results of short-term impulsive non-stationary well intake capacity testing. The method also includes a changeing of agent injection mode when well bottom zone filtration characteristics required are achieved. The characteristics are determined by the skin-effect calculated by the stored flow rate and agent flow consumption unit work in well bottom zone, taking into account the current conductivity of a bed), according to the invention, on injection line in front of the wellhead it is set a measuring section of a length allowing to fix pressure drops when flow medium of minimum hydraulic friction flowing. The section is in the form of a calibrated pipe with assembled flow sensors, a pressure sensor and an additional differential manometer with impulsive pipes connected with the start and the end of the measuring section. Pressure, flow rate and pressure drops are measured at the measuring section.

To determine a water permeability, piezoconductivity and radius of well bottom zone and skin-effect coefficient, a repression function is determined for every gaging in conditions of non-stationary formation water injection during every injection mode, the function characterizes a non-stationary flow in a well bottom zone during the given fluid injection mode. The method also includes a construction of the repression function-logarithm of injection time diagram, highlighting of initial sloping straights on every diagram obtained, finding parameters of highlighted straights by the least-squares method, by which it is possible to determine a water permeability and piezoconductivity of polluted bottomhole formation zone, as well as its radius and skin-effect coefficient.

To determine a water permeability of producing formation, a stored flow rate and a repression function, characterizing the work required for a non-steady state flow of the formation water consumption unit are determined. A repression derived function-stored flow rate diagram for a bed water permeability range, a fortiori including the desired bed water permeability and possibility of choice among a great number of curves of derived line, which is in nearby conformity with the derived function constancy condition is constructed. The derived function corresponds to the desired water permeability of bed.

It is known a control device for a gas well. The device installed at gas wellhead to determine pressure at wellhead contains a fixed measuring complex. The latter has gas pressure and temperature sensors entered in a gas flow through wellhead. To provide systematic control over measurements conducted by the sensors, the measuring block contains an automatic device providing periodical thieving from gas flow passing through wellhead. A processor is connected to this device providing gas pressure calculation at well bottom basing on the data obtained from the sensors installed in gas flow passing through the wellhead. A memory block providing gas pressure and temperature data receive and storage is connected to the processor, the data enter the memory block of the processor in specified periods. A display is connected up to the memory block and indicates a digital information on pressure and temperature in gas flow passing through the wellhead, as well as the information on gas pressure at well bottom. (# U.S. Pat. No. 4,414,846 of the USA, class 37-151, published in 1983)

The known device allows parameters of medium passing out from well to be controlled and is not capable to control parameters when the agent injecting in well.

A device for flow rate and direction of flow movement measuring is the most close to the invention. The device includes two unequal electric impulse sensors spaced ∠180° apart in a hydraulic channel in plane perpendicular to the hydraulic channel. The sensors are connected to a trigger through a selector of amplitude impulses, an integrating block with a flow direction recorder is installed at the outlet of the trigger. (Patent # 2055984 of the Russian Federation, E class 21 B 47/00, published in 1996—prototype).

The known device allows for measuring of agent flow rate when its injection in a well and its movement direction in well, but does not allow one to control such parameters as pressure and its change. Besides, the device makes it possible to determine parameters only directly in the point of determination and does not make it possible to determine remote parameters, for example at well bottom.

The problem in increasing the number of parameters being measured and improving well, bottomhole formation zone and bed characteristics determination accuracy is solved in this invention.

The problem is solved in the following way: according to the invention, the device for well potential determination, including a flow rate sensor and an apparatus for measuring and recording the agent parameters has a measuring section on injection line in front of the wellhead. The length of the section makes it possible to fix pressure drops when flow medium of minimum hydraulic friction flowing. The section is in the form of a calibrated pipe with assembled flow sensors, a pressure sensor and an additional differential manometer with impulsive pipes connected with the start and the end of the measuring section. To record medium parameters, there is a remote block, a data collection block and a computer. Sensors determining temperature and density can be located at the measuring section.

THE ESSENCE OF THE INVENTION

When well intake capacity testing and determining well potential, well bottom zone parameters, water permeability of producing formation and well bottom zone treatment, it is required to evaluate effectiveness of such treatments, especially when fluids of difficult rheology—non-Newtonian fluids—are injected, because a surcharge of agents can occur and it can become impossible to fulfill the tasks of treatment on account of inaccurate and untimely received information. To solve these problems, it is required a wellhead information and measuring complex for well treatment process data record. The comlex permits to control over well treatment parameters, to make prompt interventions as well as research the condition of well bottom zone. The invention suggested solves the above problems.

The information and measuring complex suggested provides for measuring parameters required at wellhead on injection line when the agent injecting in well.

The injection line is provided with a measuring section in the form of a calibrated pipe equipped with a differential manometer with impulsive pipes connected with the start and the end of the section as well as flow rate and pressure sensors. To record medium parameters there is a remote block, a data collection block and a computer. The measuring section is of length allowing fixing pressure drops as flow mediums of minimum hydraulic friction flows. As this takes place, on the measuring section it is possible to fix pressure drops as flow mediums of high hydraulic friction flows, for example polymer solutions, cements, and so on. The length of the measuring section depends on the sensitivity of measuring devices applied and the measurement accuracy required. The measuring section can locate other sensors, for example density and temperature sensors.

The information and measuring complex measures and records a wellhead pressure, pressure drops at the measuring section and a volume flow rate of the fluid injected. Bottomhole pressure and other indices are being calculated for every measurement on these data in real time of the process, taking into account a borehole deviation, rheology and heating of the fluid, resulting in a hydrostatic pressure change and fluid friction loss in tubing. Determination of flowing bottom hole pressure when injecting in tubing usual Newtonian fluids in any sequence, as well as polymer solutions, muds and cements and other non-Newtonian fluids is being considered.

FIG. 1 represents an information-and-measurement complex, the device for well, well bottom zone and bed characteristics determination.

The device includes a measuring section 1 with flow sensors 2, a pressure sensor 3, differential manometer 4 with impulsive pumps 5,6 connected with the upper and lower borders of the section. The device is connected with a well 8 through an injection line 7. The measuring section 1 has a length allowing fixing pressure drops when minimum hydraulic friction fluid mediums flowing.

Figure 2:
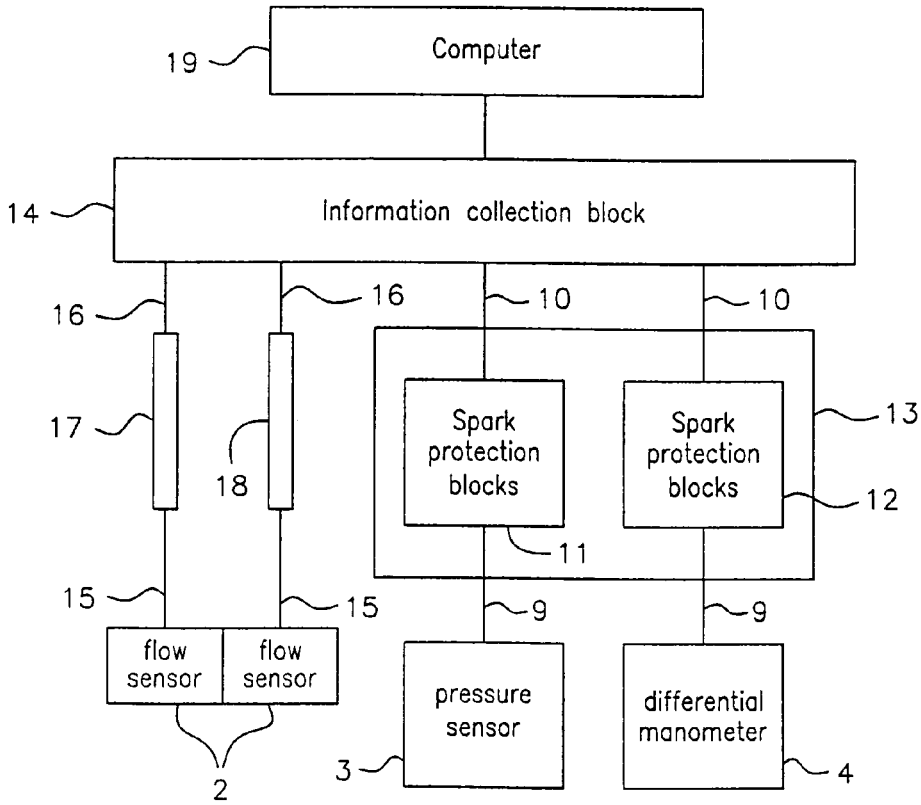

FIG. 2 represents an electric scheme of the device for well, well bottom zone and bed characteristics determination.

Outlets of the pressure sensor 3 and differential manometer 4 are connected with spark protection blocks 11 and 12 and an information collection block 14 through electric cables 9 and 10. The blocks 11 and 12 are located in a remote block 13. Outlets of flow sensors 2 are connected with secondary flow sensors 17 and 18 and then, with the information collection block 14 through electric cables 15 and 16. The information collection block 14 is connected with a computer 19.

The device works in the following way.

When the working substance is injected through the measuring section 1 in the well 8, analogous signals from the pressure sensor 3 and differential manometer 4 by means of electric cables 9 and 10 through the spark protection blocks 11 and 12 enter the remote block 13 and then, the information collection block 14. Galvanic isolation of electric circuit is being made in the spark protection blocks 11 and 12.

Frequency signals from the flow sensors 2 enter the secondary flow sensors 17 and 18 by means of electric cables 15 and then, enter suitable channels of the information collection block 14 by means of electric cables 16.

The information collection block 14 converts the signals in digital form and transfers them in the computer 19. The information entered is visualized and stored in the computer memory.

When an oil reservoir is treated to stimulate production or water shutoff, levelling or absorption of fluid-movement profile, injected working fluid flow remains relatively constant only during some very short periods of time and changes in a wide range during the whole treatment. The method suggested initially includes impulsive non-stationary agent injection as the most common and suitable for production conditions. A stationary injection mode applied in practice under special conditions is a special case of general impulsive non-stationary mode; in this case all calculations and conclusions of the method suggested are correct. Impulsive non-stationary agent injection is characterized by substantial variability of flow rate and pressure with random changes in amplitude and frequency. An amplitude of flow rate can be changed from 0.084 to 7.6 l/s, frequency—from 0.002 to 0.02 hertz; in this case the maximum flow rate provides non-development of artificial fracturing in a bottom hole zone (maximum admissible bottom-hole pressure in fluid injecting should be lower than the fracture opening pressure in a well bottom hole zone). The amplitude of wellhead injection pressure may change from 1 to 10÷15 MPa at the same frequency.

When the well is treated, an information and measuring complex measures and records the wellhead pressure, density, pressure drops at the measuring section and volume flow rate of the agent injected at 5÷60 s intervals (i.e. at 5÷60 s period of scanning). Bottom-hole pressure and other indices are calculated for every measurement on these data in real time of the process, taking into account a borehole deviation, rheology and heating of the fluid, resulting in a hydrostatic pressure change and fluid friction loss in tubing, when injecting in tubing usual Newtonian fluids, as well as polymer solutions, muds and cements and other non-Newtonian fluids in any sequence.

When the well is treated, several fluids different in physical and chemical characteristics are sequentially injected in well. At the α stage α fluid is injected (when α=1; 2 and so on, depending on the number of fluids for injection). $G_\alpha$, $U_\alpha$ auxiliary parameters are calculated in real time of the process for every gaging of α fluid injected flow rate $Q_\alpha(t)$ and $\Delta P_{I3M}(t)$ pressure drop at the measuring section:

$$G_\alpha = \frac{Q_\alpha(t)}{d_{I3M}^3}, \qquad U_\alpha = \frac{d_{I3M} * \Delta P_{I3M}(t)}{L_{I3M}}, \tag{1}$$

where $Q_\alpha(t)$—flow rate of α injected fluid in the moment of time t after the injection is started, $m^3$/day;

$d_{I3M}$—internal diameter of the measuring section, m;

$L_{I3M}$—length of the measuring section (distance between impulsive pipes axes at the measuring section), m;

$\Delta P_{I3M}(t)$—pressure drops at the measuring section (between impulsive pipes axes at the measuring section) at the time t after injection of α fluid is started, MPa;

α—sequence number of the fluid injected.

Dimensions of the auxiliary parameters $G_\alpha$, $U_\alpha$ are as follows:

$|G_\alpha|$=1/day; $|U_\alpha|$=MPa.

Values of the auxiliary parameters $G_\alpha$ and $U_\alpha$, calculated by formulas (1) for the current temporal value t, are plotted at graph $$U_\alpha = U_\alpha(G_\alpha) \tag{2}$$

Figure 3:
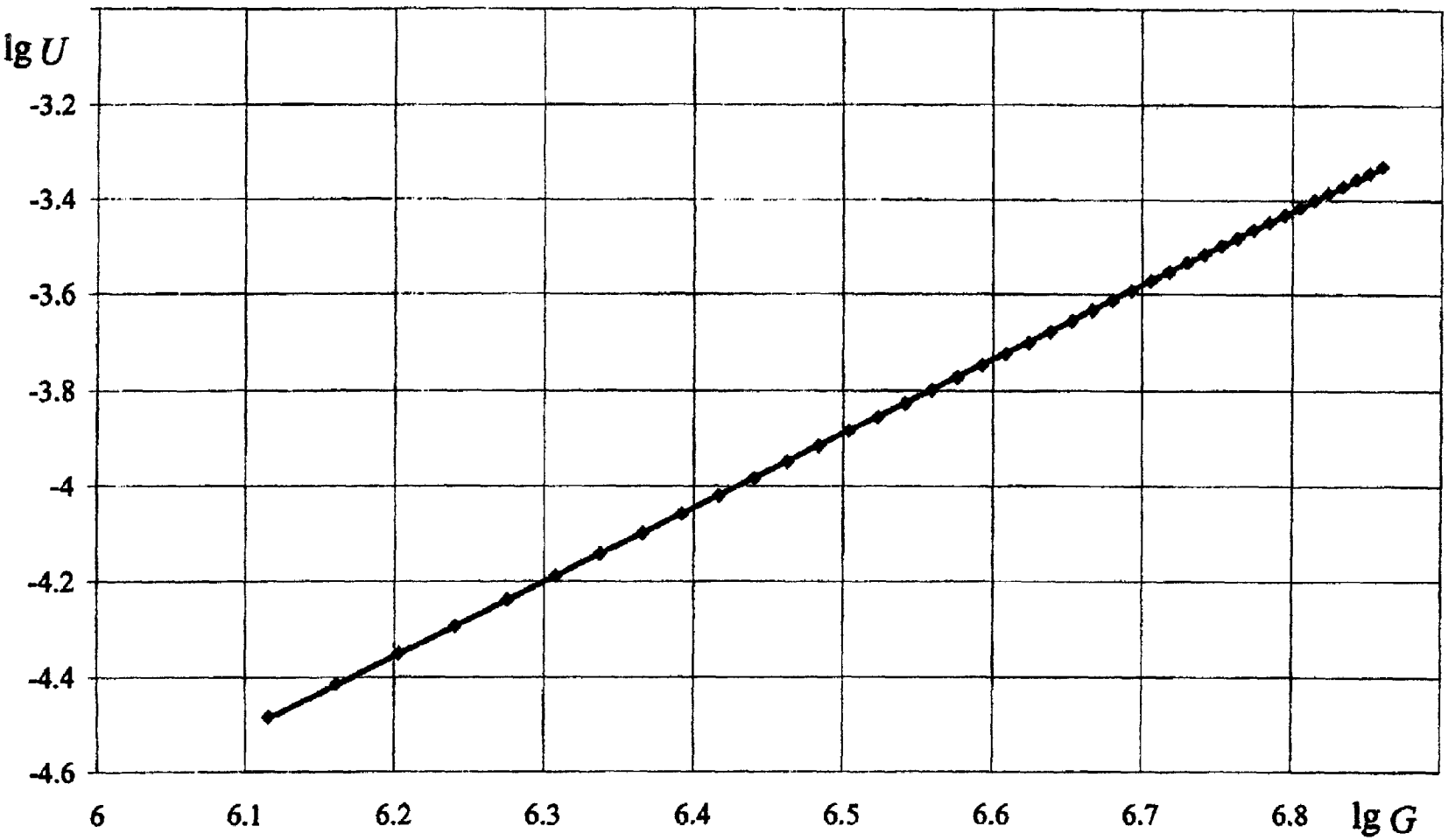

FIG. 3 represents $G_\alpha$–$U_\alpha$ graph at the example of the gelling agent injection in a well: a water solution of copolymer "Kometa" and "DEG" resin, where horizontal, or X axis represents the values of 1 g G the vertical, or Y axis represents the values of 1 g U.

After the first 30÷40 values of $U_\alpha$, $G_\alpha$ are received, an approximation of pixel array received is made by matching of functional dependence $U_\alpha=U_\alpha(G_\alpha)$. As the new data (values of $U_\alpha$, $G_\alpha$) become available, at a later time the dependence $U_\alpha=U_\alpha(G_\alpha)$ is adjusted.

After the functional dependence (2) for every measuring of flow rate $Q_\alpha(t)$ of α fluid is established, an auxiliary parameter $\overline{G_\alpha}$ is calculated in real time of the process.

$$\overline{G_\alpha} = \frac{Q_\alpha(t)}{d_{HKT}^3}, \tag{3}$$

where $d_{HKT}$—internal diameter of tubing, m.

Dimension of the auxiliary parameter: $|\overline{G_\alpha}|$=1/day.

If $$\overline{G_\alpha} = G_\alpha, \tag{4}$$

$\overline{U_\alpha}$ is determined from the functional dependence $U_\alpha=U_\alpha(G_\alpha)$. $\overline{U_\alpha}$ is an accordance with $\overline{G_\alpha}=G_\alpha$:

$$\overline{U_\alpha} = U_\alpha(\overline{G_\alpha}) \tag{5}$$

Dimension of the auxiliary parameter: $|\overline{U_\alpha}|$=MPa.

λ[(fluidα), Δt], α fluid flow resistance in tubing coefficient is calculated for every gaging of $Q_\alpha(t)$ flow rate in real time of the process:

$$\lambda[({}^{fluid}\alpha), \Delta t] = \frac{9.2095 * 10^{15} * \overline{U}_\alpha * d_{HKT}^4}{\rho_{YCT}({}^{fluid}\alpha) * Q_\alpha^2(t)}, \tag{6}$$

where $\overline{U_\alpha}$—auxiliary parameter determined by formula (5), MPa, $d_{HKT}$—internal diameter of tubing, m, $\rho_{YCT}$(fluidα)—density of α injected fluid in wellhead conditions, kg/$m^3$;

$Q_\alpha(t)$—flow rate of α injected fluid at t time of injection, $m^3$/day;

λ[(fluidα),Δt]—α a fluid flow resistance tubing coefficient, dimensionless quantity.

Values of λ[(fluidα),Δt], α fluid flow resistance tubing coefficient, determined from the formula (6) is plotted at α fluid—λ[(fluidα),Δt] graph:

$$\lambda[(\text{fluid}\alpha),\Delta t] = \Phi(Q_\alpha(t) \tag{7}$$

Figure 4:
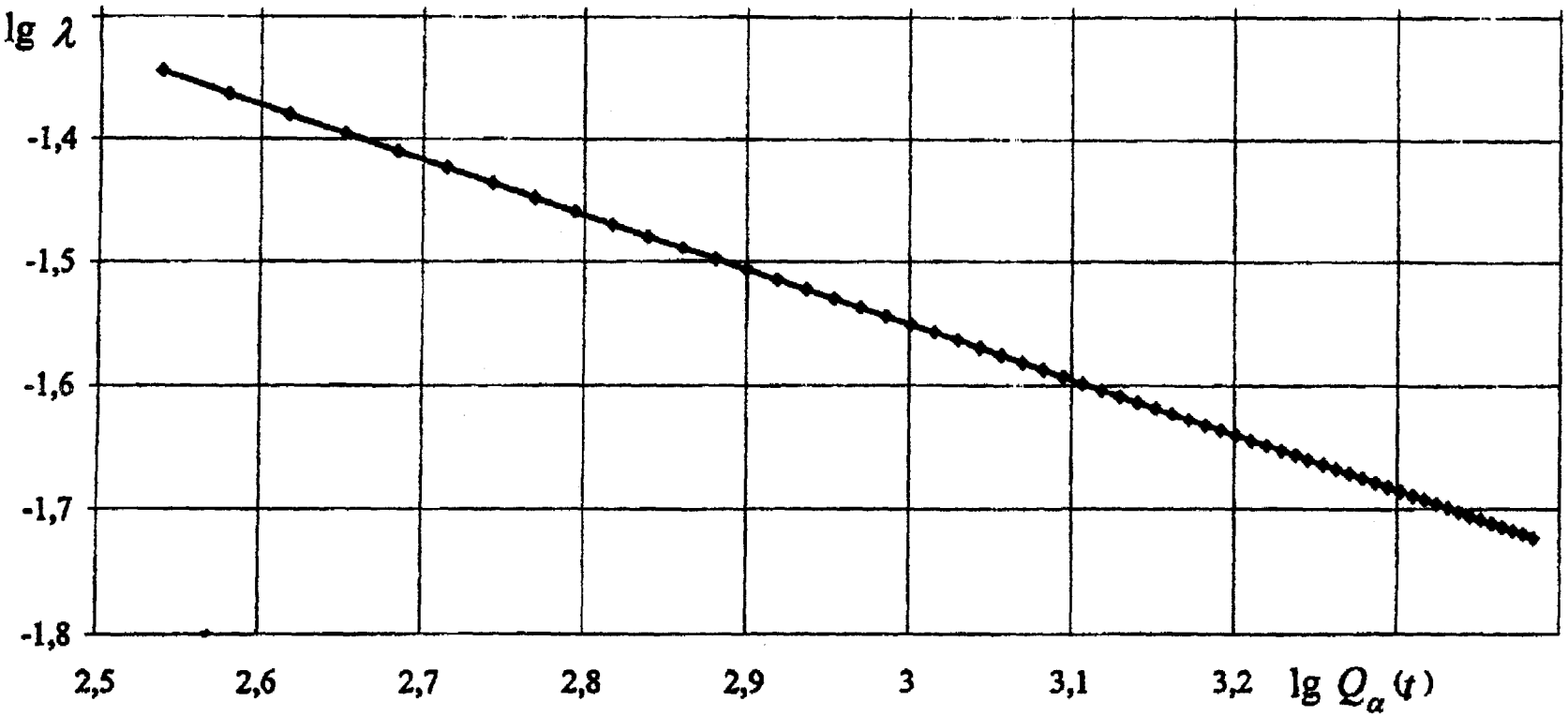

FIG. 4 represents a λ[(fluidα),Δt ]—$Q_\alpha(t)$ graph. $Q_\alpha(t)$ is a gelling agent (a water solution of "Kometa" copolymer and "DEG" resin) flow rate. Horizontal, or X axis represents the values of 1 g $Q_\alpha(t)$, the vertical, or Y axis represents the values of 1 g λ[(fluidα),Δt].

After the first 30÷40 points of [λ and Q(t) values] are received, an approximation of pixel array received is made by matching correlation dependence $\lambda[(\text{fluid}\alpha),\Delta t]=\Phi(Q_\alpha(t))$. As the new data [$\lambda$ and Q(t)values] become available, at a later time the dependence (7) is adjusted.

$\lambda[(\text{fluid}\alpha),\Delta t]$, $\alpha$ fluid flow resistance in tubing coefficient is calculated for every gaging of $Q_\alpha(t)$ flow rate by the correlation dependence $\lambda[(\text{fluid}\alpha),\Delta t]=\Phi(Q_\alpha(t))$ in real time of the process:

Basing on the data obtained, $P_{TP}(t)$ pressure losses due to $\alpha$ fluid friction in tubing are calculated in real time of the process:

$$P_{TP}(t) = 0.10858 * 10^{-15} * \lambda[({}^{fluid}\alpha), \Delta t] * \frac{\rho_{YCT}({}^{fluid}\alpha) * L * Q_\alpha^2(t)}{d_{HKT}^5},$$

where $P_{TP}(t)$—pressure losses due to $\alpha$ fluid friction in tubing at t time, MPa;

L—length of tubing (wellbore distance from wellhead to tubing string shoe), m;

$\lambda[(\text{fluid}\alpha),\Delta t]$—$\alpha$ fluid flow resistance tubing coefficient, determined for every gaging of $Q_\alpha(t)$ flow rate by the correlation dependence (7)

$$\lambda[(\text{fluid}\alpha),\Delta t]=\Phi(Q_\alpha(t));$$

$d_{HKT}$—internal diameter of tubing, m;

$\rho_{YCT}(\text{fluid}\alpha)$—density of $\alpha$ fluid in wellhead conditions, kg/m$^3$;

$Q_\alpha(t)$—flow rate of $\alpha$ fluid at t time of injection, m$^3$/day.

$P_C(t)$ flowing bottomhole pressure at the depth of tubing string shoe, L at current time t equals:

$$P_C(t)=P_{YCT}(t)+P_\Gamma(t)-P_{TP}(t), \tag{9}$$

where:

$P_C(t)$—bottom-hole pressure at the current time t of $\alpha$ fluid injection, MPa;

$P_{YCT}(t)$—wellhead pressure at t time of $\alpha$ fluid injection, MPa;

$P_\Gamma(t)$—$\alpha$ liquid head at t time, MPa;

$P_{TP}(t)$—pressure losses due to $\alpha$ fluid friction in tubing at t time, MPa determined by the formula (8).

$\Delta P_C(t)$ repression to the bed at t time of $\alpha$ fluid injection equals:

$$\Delta P_C(t)=P_C(t)-P_{\Pi\Pi\Pi}, \tag{10}$$

where $P_{\Pi\Pi\Pi}$—formation pressure reduced to the depth of tubing string shoe, L, MPa.

To determine S coefficient of skin-effect in well treatment, a wellhead pressure, density and volume flow rate of $\alpha$ fluid injected are measured and recorded at 5÷60 s intervals (i.e. at 5÷60 s period of scanning). $P_{TP}(t)$, pressure losses due to $\alpha$ fluid friction in tubing, $P_\Gamma(t)$ $\alpha$ liquid head, $P_C(t)$ bottom-hole pressure by the formula (9) are calculated on these data for every measurement in real time of the process, $\Delta P_C(t)$ repression to the formation by the formula (10), Q(t) volume flow rate in bottom-hole conditions. Next is a determination of $Y(t_N)$ repression function value characterizing the work required for a non-steady state flow of $\alpha$ fluid consumption unit in a well bottom zone by the formula:

$$Y(t_N) = \sum_{n=0}^{n=N-1} 0.5 * [\Delta P_C(t_n) + \Delta P_C(t_{n+1})] * [t_{n+1} - t_n] - \sum_{n=0}^{n=N-1} \frac{Q_n}{4 * \pi * \varepsilon} * [t_{n+1} - t_n] * \ln[0.5 * (t_{n+1} - t_n)] - \sum_{n=0}^{n=N-2} \sum_{i=0}^{i=n} \frac{Q_i}{4 * \pi * \varepsilon} * [t_{n+1} - t_n] * \ln \frac{0.5 * (t_{n+1} + t_n) - t_i}{0.5 * (t_{n+1} + t_n) - t_{i+1}}, \tag{11}$$

where

N=2; 3; 4; . . . –number of the current gaging of wellhead pressure, density and volume flow rate of $\alpha$ injected fluid;

n=0; 1; 2; 3; . . . N−1—numbers of previous gaging;

$t_0$—injection-on time (initial gaging n=0), s;

$t_1$; . . . $t_n$—time of the first, . . . n gaging, s;

$t_N$—time of the current gaging, s;

$\Delta P_C(t_O)$; . . . $\Delta P_C(t_n)$—repression to the formation at the start of injection and at $t_n$ time of n previous gaging, Pa;

$\Delta P_C(t_N)$—repression to the formation at $t_N$ time of the current N gaging, Pa;

$Q_0$, . . . $Q_n$—volume flow rate of $\alpha$ fluid in bottom-hole conditions at the start of injection and at the time of n previous gaging, m$^3$/s;

$Y(t_N)$—repression function, characterizing the work required for a non-steady state flow of $\alpha$ fluid consumption unit in a well bottom zone at $t_N$ current time from the start of the process, Pa*s:

$\epsilon$—water permeability of bed, m$^2$*m/Pa*s:

$$\varepsilon = \frac{k * h}{\mu}; \tag{12}$$

k—in-place permeability for formation water, m$^2$;

h—effective thickness of producing formation absorbing the fluid injected, m;

$\mu$—viscosity of formation water, Pa*s.

Concurrent with the $Y(t_N)$ repression function calculation, a $W(t_N)$ stored volume of fluid in bottom-hole conditions entered the formation up to the $t_N$ time from the start of injection is calculated by the formula:

$$W(t_N) = \sum_{i=0}^{i=N-1} 0.5 * (Q_i + Q_{i+1}) * (t_{i+1} - t_i). \tag{13}$$

$Y(t_N)$ and $W(t_N)$ obtained values are plotted.

Figure 5:
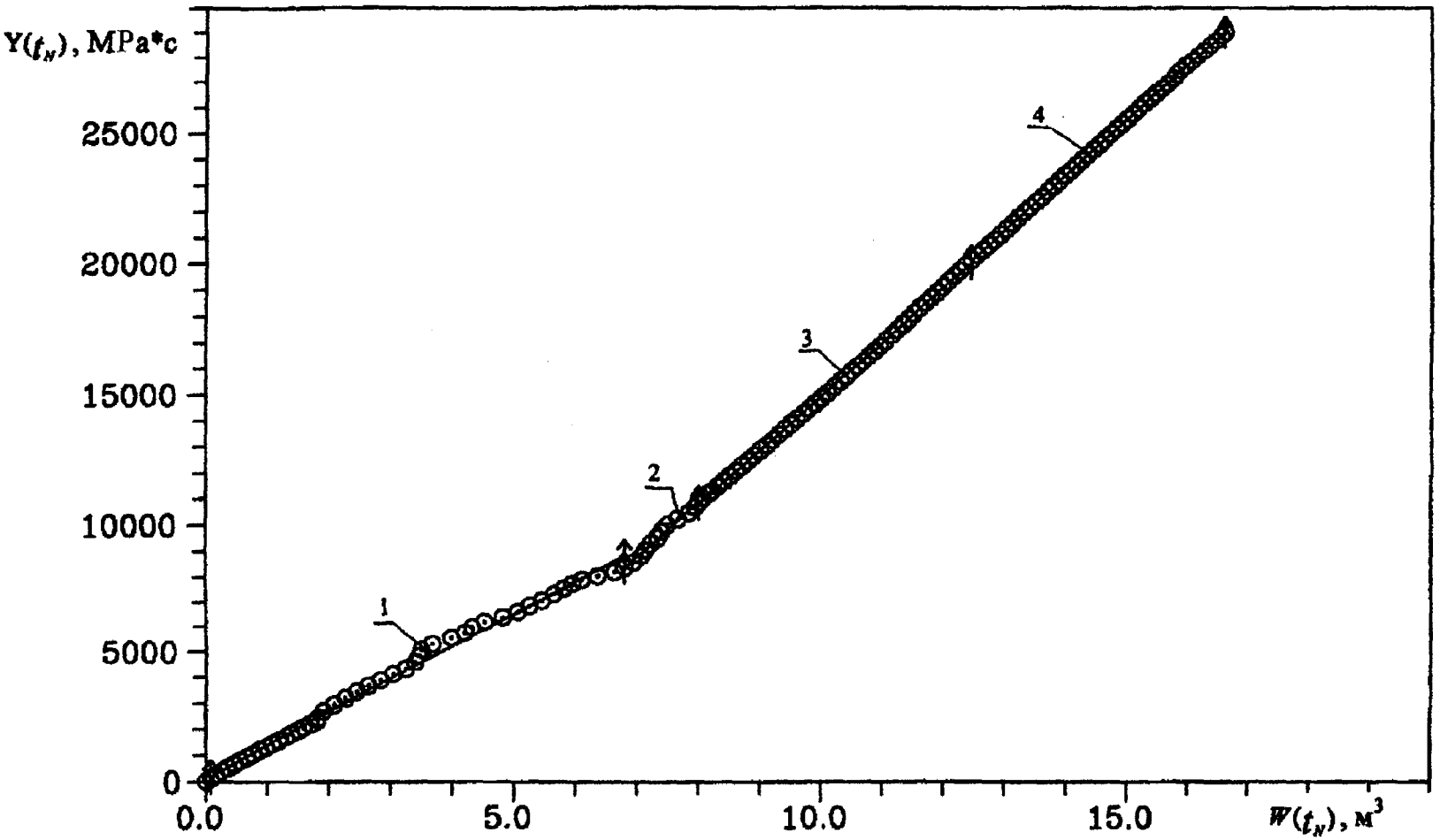

FIG. 5 represents $Y(t_N)$–$W(t_N)$graph at the example of gelling agent injection in well: a water solution of "Kometa" copolymer and "DEG" resin, where horizontal, or X axis represents the values of $W(t_N)$ stored volume, m$^3$, the vertical, or Y axis represents the values of $Y(t_N)$ repression function, MPa*s.

The following conventional signs are agreed at the FIG. 5: 1—the first straight portion in injection of 6.7 m$^3$ gelling agent to the formation, 2—the second straight portion in the following injection of 1.2 m$^3$ gelling agent to the formation, 3—the third straight portion in the following injection of 4.4 m$^3$ gelling agent to the formation, 4—the fourth straight portion of 4.2 m$^3$ formation water in depression to the formation.

If digital records of wellhead parameters and a computer analysis system are available, determinations of $Y(t_N)$, $W(t_N)$ values and plotting of dependence $$Y(t_N)=Y[W(t_N)] \tag{14}$$

are made directly in well treatment in real time.

An approximation of separate dependence graph (14) sections is made by straight sections. A slope of straight portion $B_j$ is determined at $[t_j, t_{j+1}]$ linear approximation time interval. The value of $S_j$ skin-effect coefficient reflecting the condition of a well bottom zone at $[t_j, t_{j+1}]$ time interval of operation is determined by the formula:

$$S_j = 2*\pi*\varepsilon*B_J - 0.5*\ln\frac{2.246*\chi}{r_c^2}, \tag{15}$$

where $S_j$—coefficient of skin-effect reflecting additional uplifts to fluid flow due to pollution and defects in well bottom zone exposing at $[t_j, t_{j+1}]$ time interval of operation;

$r_c$—radius of well, m;

x—piezoconductivity of producing formation, $m^2/s$, $B_j$—slope of plot (14) at $[t_j, t_{j+1}]$ time interval of treatment, $Pa*s/m^3$.

After the planned value of skin-effect is achieved, an injection mode is changed up to the injection is stopped.

When determining $\epsilon$ water permeability of bed, formation water is injected in a producing or injection well. Till the injection is made, a M random row of $\epsilon_m$ values of water permeability of bed is established:

$$\epsilon_1<\epsilon_2<\ldots<\epsilon_m<\ldots<\epsilon_M, \tag{16}$$

which a fortiori including the true value of water permeability of bed ($\epsilon_{ICT}$):

$$\epsilon_1<\epsilon_{ICT}<\epsilon_M. \tag{17}$$

Formation water is injected in a well by the method of impulsive non-stationary injection. In doing so, wellhead pressures, density and volume flow rate of formation water injected are measured at wellhead and recorded. $P_{TP}(t)$, pressure losses due to $\alpha$ fluid friction in tubing, $P_T(t)\alpha$ liquid head, $P_C(t)$ bottom-hole pressure are calculated on these data by the formula (9) for every measurement in real time of the process, $\Delta P_C(t)$ repression to the formation by the formula (10), and Q(t) volume flow rate in bottom-hole conditions.

And then the values of $\Delta Y_m/\Delta X_m(t_N)$ repression derived function are determined for every adopted value of $\epsilon_m$ water permeability of formation by the formula:

$$\Delta Y_m/\Delta X_m(t_N) = 4*\pi*\varepsilon_m*\frac{\Delta P_C(t_N)+\Delta P_C(t_{N-1})}{Q_N+Q_{N-1}} - \frac{2*Q_{N-1}}{Q_N+Q_{N-1}}*\ln[0.5*(t_N-t_{N-1})] - \sum_{i=0}^{i=N-2}\frac{2*Q_i}{Q_n+Q_{N-1}}*\ln\frac{0.5*(t_N+t_{N-1})-t_i}{0.5*(t_N+t_{N-1})-t_{i+1}}, \tag{18}$$

where:

N, N−1—numbers of the current and previous gaging (N=2; 3; 4; . . . ) of wellhead pressure, density and volume flow rate of the fluid injected;

i=0; 1; 2; . . . N−2—numbers of previous gagings;

$t_N$, $t_{N-1}$—time of the current and previous gagings, s;

$t_0$; $t_1$; . . . $t_i$—time of the previous gagings, s;

$\Delta P_C(t_N)$, $\Delta P_C(t_{N-1})$—repression to the formation in the current and previous gagings, Pa;

$Q_N$, $Q_{N-1}$—volume fluid flow rate in bottom-hole conditions in the current and previous gaging, $m^3/s$;

$Q_i$—volume fluid flow rate in bottom-hole conditions in the previous gagings, $m^3/s$;

$Y_m(t_N)$—repression function, characterizing the work required for a non-steady state flow of formation water consumption unit by $\epsilon_m$ water permeability of bed at $t_N$ time from the start of the process, Pa*s;

$\epsilon_m$—water permeability of bed adopted in calculations, $m^2*m/Pa*s$ $$\varepsilon_m = \frac{k_m*h}{\mu}; \tag{19}$$

$k_m$—in-place permeability of bed adopted in calculations, $m^2$;

h—effective thickness of producing formation absorbing the formation water injected, m;

$\mu$—viscosity of formation fluid, Pa*s.

Concurrent with $\Delta Y_m/\Delta X_m(t_N)$ calculation, a $W(t_N)$ stored volume of fluid in bottom-hole conditions entered the formation up to the $t_N$ time from the start of injection is calculated by the formula (13)

The values obtained are plotted.

Figure 6:
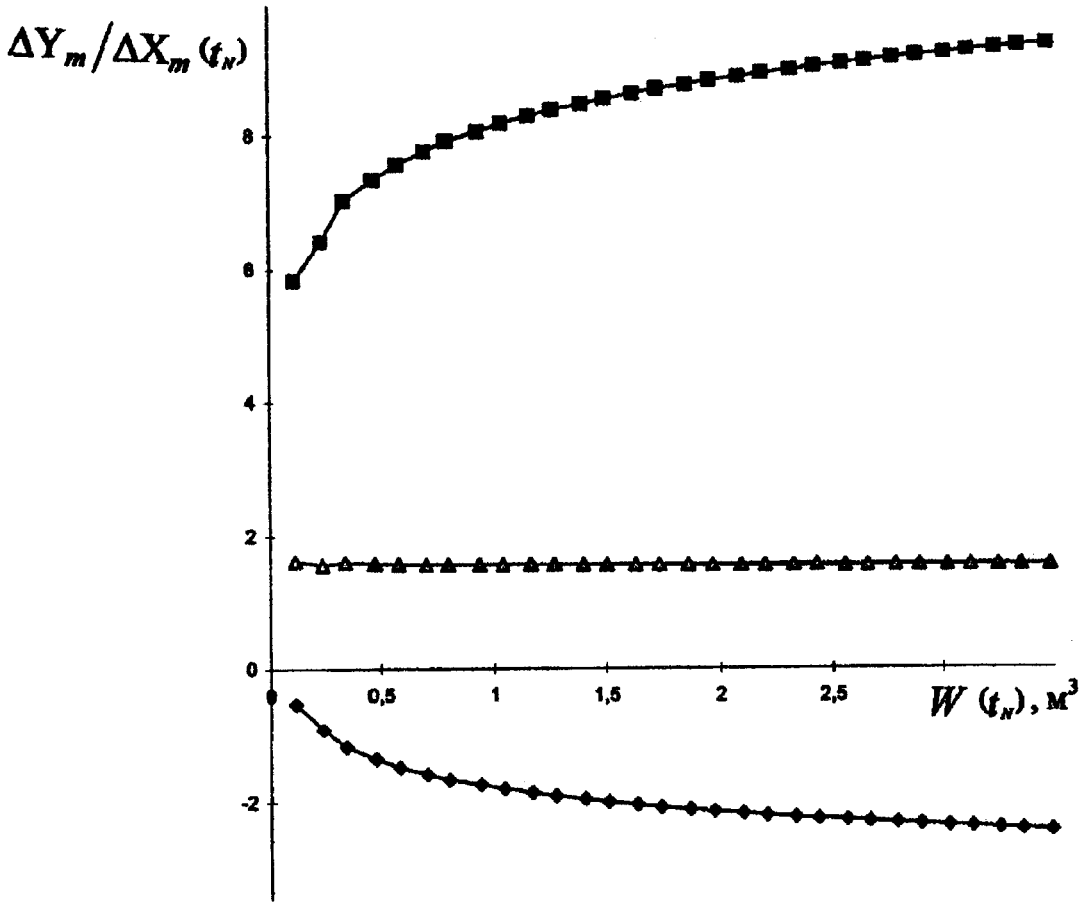

FIG. 6 represents $\Delta Y_m/\Delta X_m(t_N)$–$W(t_N)$ graph at the example of the gelling agent injection in a well: a water solution of "Kometa" copolymer and "DEG" resin, where horizontal, or X axis represents the values of $W(t_N)$ stored volume, $m^3$, the vertical, or Y axis represents the values of $\Delta Y_m/\Delta X_m(t_N)$ repression derived function, MPa*s.

The following conventional signs are agreed at the FIG. 6:

-◆-—derivative graph, when the water permeability of bed is adopted in calculations as 5.1 $mkm^2*m/mPa*s$;

-■-—derivative graph, when the water permeability of bed is adopted in calculations as 20.4 $mkm^2*m/mPa*s$;

-Δ—derivative graph, when the water permeability of bed is adopted in calculations as 10.3 $mkm^2*m/mPa*s$.

ΔY/ΔX derivative graphs substantially depend on adopted $\epsilon_m$ water permeability of bed. The closer $\epsilon_m$ values to the true value of $\epsilon_{ICT}$ water permeability of formation, the closer ΔY/ΔX derivative graphs to a line parallel to abscissa axis. If the $\epsilon_{ICT}$ true value is in the range (17), among the graphs obtained $$\Delta Y_m/\Delta X_m(t_N)=\Delta Y_m/\Delta X_m[W(t_N)] \tag{20}$$

there are one or two lines which are in better conformity with the following condition, than the others:

$$\Delta Y/\Delta X[t,\ \epsilon_{ICT}]=\text{const.} \tag{21}$$

Further, $\epsilon$ value of water permeability of bed is determined by the known method of successive approximation, ΔY/ΔX derivative can be adopted as constant in the best way. Optimal fulfillment of the condition (21) is reached by digital methods with the use of apparatus of practical physics. The value providing the best fulfillment of the condition (21) is the $\epsilon$ desired value of water permeability of formation.

Prior to the determination of well bottom zone parameters by the method suggested, a preliminary research is conducted so, that the $\epsilon$ water permeability of bed is adjusted and a substantial pollution of well bottom zone (S>20÷30) is found.

If the value of skin-effect obtained by this known method or another S≧20÷30, the suggested method is applied.

The indicated limit is conditioned by the modern technical level of operations for fluid injection in beds and guarantees a reliable measurement of well bottom zone parameters when flow rate and injection pressure recording, and can be reduced by applying a wellhead control station.

To implement the method suggested, a main process of impulsive non-stationary formation water injection is conducted at wellhead. The process is characterized with a variation in flow rate from minimum values, providing a stationary injection with uplift pressure at wellhead, to maximum values, providing a non-development of artificial fracturing in a well bottom zone of formation. This can be achieved by fulfillment of the following condition:

$$P_{C^{MaKC}}<\sigma_{pack}, \tag{22}$$

where $P_{C^{MaKC}}$—maximum admissible bottom-hole pressure in formation water injection, MPa; $\sigma_{pack}$—fracture opening pressure in well bottom zone, MPa.

It is established, that to receive reliable results, it is necessary to inject at several (4÷6 and more) injection modes with a sharp change of flow rate from larger to smaller and vice versa.

$\Delta\theta$ injection time is established in every mode experimentally or approximately can be evaluated as:

$$\Delta\theta \approx (0.2 \div 0.5)\frac{S}{\chi}, \tag{23}$$

where

S—value of coefficient of skin-effect, determined in preliminary well tests;

X—piezoconductivity of bed, $m^2/S$.

S coefficient in the formula (23) is dimensionless, and dimension of injection time in every mode is following: $|\Delta\theta|$= s.

Basing on the evaluations made at wellhead, the main process of impulsive non-stationary injection of formation water is conducted so, that the variable rating curve is a step function of t injection time:

$$Q_Z(\theta_Z \leqq t \leqq \theta_{Z+1})=Q_Z \approx \text{const}, \tag{24}$$

where t—current time from the start of the main injection of formation fluid, s Z=1, 2, . . . —sequence number of main injection mode;

$\theta_Z$, $\theta_{Z+1}$—time of the start and completion of the main injection Z mode (start of the first mode of injection $\theta_1$=0), s;

$Q_Z$—average flow rate during the main injection Z mode (approximate equality $Q_Z \approx$const means that in the main injection of formation water flow rate variations are admissible up to 20÷30% from the average value of $Q_Z$ flow rate in the given mode), $m^3/s$.

In the process of injection in well, a wellhead pressure, density and volume flow rate of formation water are measured and recorded at 5÷60s intervals (i.e. at 5÷60s period of scanning). $P_{TP}(t)$, pressure losses due to a fluid friction in tubing, $P_\Gamma(t)$ liquid head, $P_C(t)$ bottom-hole pressure by the formula (9), $\Delta P_C(t)$ repression to the formation by the formula (10), Q(t) volume flow rate in bottom-hole conditions are calculated on these data for every measurement in real time of the process. Next is a determination of $\Psi_Z(\Delta t_Z)$ repression function value characterizing a non-steady state flow of fluid injected in well bottom zone in the given mode of injection for every N gaging made in the current time interval $\theta_Z \leqq t_N \leqq \theta_{Z+1}$ in Z injection mode by the formula:

$$\Psi_Z(\Delta t_Z) = 2*\pi*\varepsilon*\frac{\Delta P_C(t_N)+\Delta P_C(t_{N-1})}{Q_N+Q_{N-1}} - \frac{1}{2}*\ln\frac{2.246*\chi}{r_C^2} - \frac{Q_{N-1}}{Q_N+Q_{N-1}}*\ln[0.5*(t_N-t_{N-1})] - \sum_{i=0}^{i=N-2}\frac{Q_i}{Q_N+Q_{N-1}}*\ln\frac{0.5*(t_N+t_{N-1})-t_i}{0.5*(t_N+t_{N-1})-t_{i+1}}, \tag{25}$$

where

N=2; 3; 4 . . . —number of the current gaging;

i=0 1; 2; . . . N—1—number of the previous gagings;

$\Delta P_C(t_N)$, $\Delta P_C(t_{N-1})$—repression to the formation in the current and previous gagings, Pa;

$Q_N$, $Q_{N-1}$—volume flow rate in bottom-hole conditions in the current and previous gagings, $m^3/s$;

$Q_i$—volume flow rate in bottom-hole conditions in previous gagings $m^3/s$;

$t_N$—time of the current gaging, s;

$t_0$, $t_1$, . . . $t_{N-1}$—time of the previous gagings, s;

$\Delta t_Z$—time interval of the current Z mode of the main injection when $\theta_Z \leqq t_N \leqq \theta_{Z+1}$;

$$\Delta t_Z = t_N - \theta_Z, \tag{26}$$

x—piezoconductivity of formation, $m^2/s$;

$r_c$—radius of well, m.

Value of $\Psi_Z(\Delta t_Z)$ repression function is dimensionless.

Calculations by the formula (25) are made subsequently for all gagings of wellhead parameters. A graph is constructed for every Z injection mode basing on the wellhead parameters gagings made.

Figure 7:
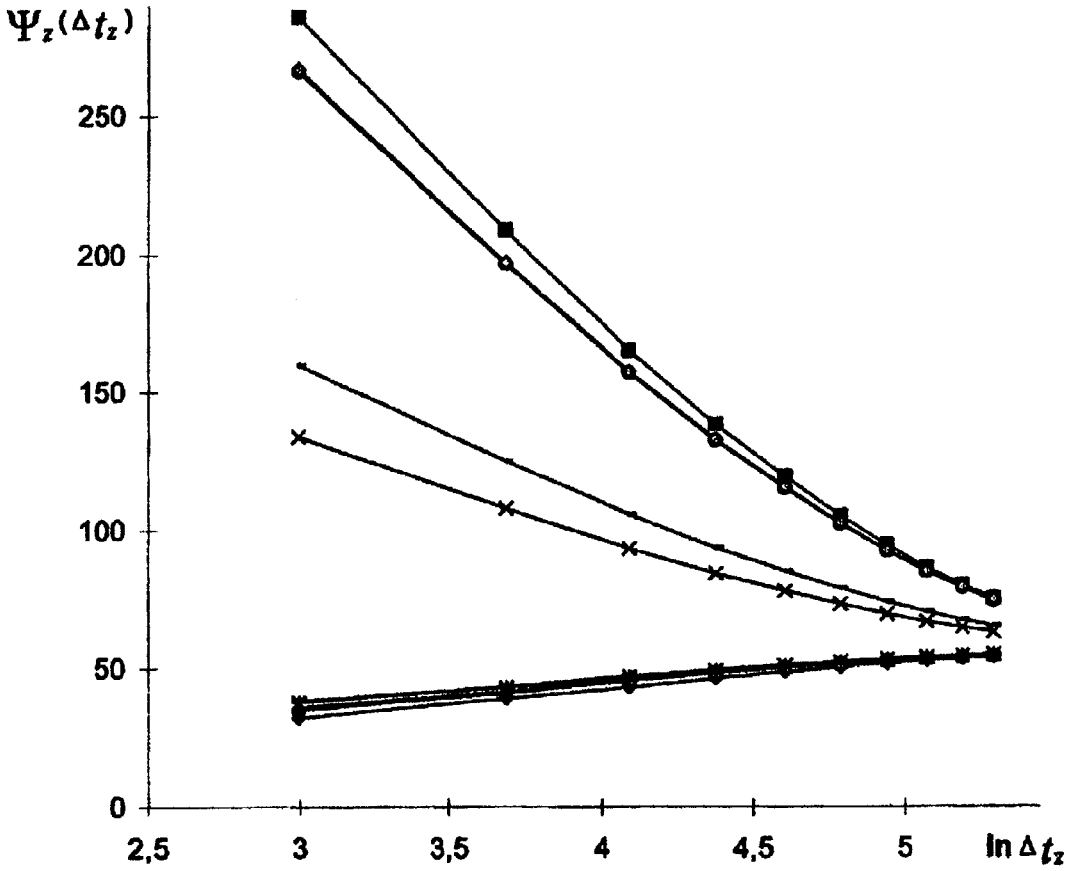

FIG. 7 represents $\Psi_Z(\Delta t_Z)$—$\Delta t_Z$ graph at the example of formation water injection in well, where horizontal, or X axis represents the values of ln $\Delta t_Z$, the vertical, or Y axis represents the values of $\Psi_Z(\Delta t_Z)$ repression derived function, appropriate to the given time interval, $\Delta t_Z$.

The following conventional signs are agreed at FIG. 7:

Z=1, 2 . . . 10—repression function graphs at $\Delta t_Z$ time period of formation water injection in well in Z mode with the flow rate $\theta_Z$: -◆—1; -■-—2; -Δ-—3; -x-—4; -*-—5; -•—6; -)(—7; -----8; ----9; -♫-—10.

If digital records of wellhead parameters and a computer analysis system are available, determination of ln $\Delta t_Z$, $\Psi_Z(\Delta t_Z)$ values and plotting of dependence $\Psi_Z(\Delta t_Z)=\Phi$ (ln $\Delta t_Z$) are made directly in the process of injection in well at $t_N$ real time of the current gaging.

So, every mode of the main injection has its own line (FIG. 7). Generally, an initial sloping straight is highlighted on every graph obtained (see example in table 1). The initial sloping straight reflects a non-steady state flow of the fluid injected in a polluted well bottom zone in the given Z mode of injection and can be described by the equation of line:

$$\Psi_Z(\Delta t_Z)=a_Z+b_Z*ln\Delta t_Z. \tag{27}$$

$b_Z$ slope and $a_Z$ initial section of highlighted straight in every Z injection mode can be found by the known least-squares method. After that the following is determined:

Water permeability of well bottom zone $\epsilon_{ПЗС}$ $$\varepsilon_{ПЗС} = \frac{Q_Z - Q_{Z-1}}{Q_Z - Q_{Z-1} + 2 * b_Z * Q_Z} * \varepsilon, \tag{28}$$

piezoconductivity of well bottom zone $X_{ПЗС}$ $$\chi_{ПЗС} = \frac{Q_Z - Q_{Z-1}}{Q_Z - Q_{Z-1} + 2 * b_Z * Q_Z} * \chi. \tag{29}$$

As all the forward equations (9) have a common point of intersection, S coefficient of skin-effect can be determined by using $a_Z$, $b_Z$, $a_{Z-1}$, $b_{Z-1}$ coefficients found for two adjacent modes of injection (Z, Z−1):

$$S = \frac{a_{Z-1} * b_Z - a_Z * b_{Z-1}}{b_z - b_{Z-1}}, \tag{30}$$

following which a $R_{ПЗС}$ radius of polluted zone is calculated:

$$R_{ПЗС} = 1,5 * \sqrt{\chi_{ПЗС} * \exp\left(\frac{S - a_z}{b_Z}\right)}. \tag{31}$$

Formulas (28)–(31) have the following dimensions of values: $[\epsilon]=m^2*m/Pa*s$;

$[X]=m^2/s$; $[R]=m$, $a_Z$, $b_Z$, S coefficients are dimensionless.

SPECIFIC EXAMPLES

Example 1

According to FIGS. 1 and 2, on Injection Line in Front of the Wellhead it is Set a Measuring Section of a 6-m Length Allowing Fixing Pressure Drops When Flow Medium of Minimum Hydraulic Friction Flowing The section is in the form of a calibrated pipe 1 of diameter 62 mm with assembled flow sensors 2 "PEA1", a pressure sensor 3 "MIDA" and a differential manometer 4 "Sapfir" -type with impulsive pipes 5 and 6 connected with the start and the end of the measuring section. The pressure, flow rate and pressure drops are measured at the measuring section 1. The measuring section 1 is of the length allowing fixing pressure drops when flow medium of minimum hydraulic friction flowing. The device is connected to a well 8 through an injection line 7.

Outlets of the "MIDA" pressure sensor 3 and "Sapfir"-type differential manometer 4 are connected with spark protection blocks "Korund" 11 and "Vzlet" 12 and an information collection block 14 through electric cables 9 and 10. The blocks 11 and 12 are located in a remote block 13. Outlets of "PEA1" flow sensors 2 are connected with secondary flow sensors "Vzlet" BII 17 and "Dnepr-7" BP 18 and then, with the information collection block 14 through electric cables 15 and 16. The information collection block 14 is connected with a computer 19 of Notebook-type.

When the working substance is injected through the measuring section 1 in the well 8, analogous signals from the pressure sensor 3 and differential manometer 4 by means of electric cables 9 and 10 through the spark protection blocks 11 and 12 enter the remote block 13 and then, the information collection block 14. Galvanic isolation of electric circuit is made in the spark protection blocks 11 and 12.

Frequency signals from the flow sensors 2 enter the secondary flow sensors 17 and 18 by means of electric cables 15 and then, enter suitable channels of the information collection block 14 by means of electric cables 16.

The information collection block 14 converts the signals in digital form and transfers them in the computer 19. The information entered is visualized and stored in the computer memory.

When the well is operated, the well bottom zone is treated at the depth of 2230 m with the aim of water shutoff Impulsive non-stationary agent injection is characterized by substantial variability of flow rate and pressure with random changes in amplitude and frequency. The amplitude of flow rate can be changed from 0.084 to 7.61/s, frequency—from 0.002 to 0.02 hertz. The amplitude of wellhead injection pressure may change from 1 to 10÷15 MPa at the same frequency.

Well treatment includes injection of some portions of gelling agent (α=1) into a well bottom zone and its depression by formation water (α=2) A water solution of <<Kometa>> copolymer and <<DEG>> resin is used as a gelling agent and form a system of apparent viscosity. An initial flow rate of injection is 5.3 1 /s.

When the gelling agent is injected, the wellhead pressure, density, pressure drops at the measuring section and volume flow rate of the agent injected are measured and recorded at 5 s period of scanning. $G_1$, $U_1$ auxiliary parameters are calculated in real time of the process for every gaging of $Q_1(t)$ fluid injected flow rate and $\Delta P_{ІЗМ}$ (t) pressure drop at the measuring section by the formulas (1). So, tubing was fully filled with the water solution of "Kometa" copolymer and "DEG" resin at t=1150 s, in this case the wellhead gagings of flow rate, wellhead pressure and pressure drops at the measuring section equal respectively to:

$Q_1(t)$=829.44 m³/day; $P_{УСТ}(t)$=13.614 MPa and $\Delta P_{ІЗМ}(t)$=0,01 MPa.

Then, $G_1$, $U_1$ auxiliary parameters at t=1150 s from the formula (1) equal to:

$$G_1 = \frac{Q(t)}{d_{ИЗМ}^3} = \frac{829.44}{0.062^3} = 3.480 * 10^6 \text{ 1/day};$$

$$U_1 = \frac{d_{ИЗМ} * \Delta P_{ИЗМ}(t)}{L_{ИЗМ}} = \frac{0.062 * 0.01441}{6} = 1.489 * 10^{-4} \text{MPa},$$

where:

$d_{ІЗМ}$=0,062 m—internal diameter of the measuring section;

$L_{ІЗМ}$=6 m—length of the measuring section (distance between impulsive pipes' axes at the measuring section).

Values of $G_1$, $U_1$ auxiliary parameters calculated by the formulas (1) for t time are plotted at the graph (FIG. 3)

$$U_1=U_1(G_1),$$

where horizontal, or X axis represents the values of 1 g G the vertical, or Y axis represents the values of 1 g U.

After the first 40 values of $U_1=U_1(G_1)$ are received, an approximation of pixel array received is made by matching of the correlation dependence:

$$U_1=10^{-13.981}*G_1^{1.5525}.$$

As the new data ($G_J$ and $U_J$) become available, at a later time the parameters of functional dependence $U_\alpha=U_\alpha(G_\alpha)$ practically have not been changed.

After the correlation dependence is established (2), an auxiliary parameter, $\overline{G_1}$ is calculated in real time by the formula (3) for each gaging of $Q_1(t)$ flow rate of gelling agent So, for t=1150 s:

$$\overline{G}_1 = \frac{Q_1(t)}{d_{HKT}^3} = \frac{829.44}{0.059^3} = 4.039*10^6 \text{ 1/day},$$

where $d_{HKT}$=0.059 m—internal diameter of tubing.

If $\overline{G_1}=G_1=4.039*10^6$1/day, we can determine $\overline{U_1}$ from the correlation dependence (2) $U_1=U_1(G_1)$:

$$\overline{U_1}=10^{-13.981}\cdot\overline{G}^{1.5525}=10^{-13.981}*(4.039*10^6)^{1.5525}==1.884810^{-4} \text{ MPa}.$$

λ[(fluid1),Δt] gelling agent flow resistance tubing coefficient is calculated for every gaging of Q(t) by the formula (6). So, for t=1150 s, when $Q_1$(t=829.44 $m^3$/day:

$$\lambda[(^{fluid}1),\Delta t] = \frac{9.2095*10^{15}*\overline{U}_\alpha*d_{HKT}^4}{\rho_{YCT}(^{fluid}\alpha)*Q_\alpha^2(t)} = \frac{9.2095*10^{15}*1.884*10^{-4}*0.059^4}{1000*829.44^2} = 3.056*10^{-2},$$

where $\overline{U_1}=1.884*10^{-4}$ MPa—auxiliary parameter; $d_{HKT}$=0.059 m—internal diameter of tubing $\rho_{YCT}$(fluid1) =1000 kg/$m^3$—density of the gelling aent in wellhead conditions, kg/$m^3$; $Q_1$(t)=829.44 $m^3$/day—fluid flow rate at t=1150 s time; λ⌊(fluid1),Δt⌋=$3.056*10^{-2}$—gelling agent flow resistance tubing coefficient when $Q_1$(t)=829.44 $m^3$/day.

Values of λ⌊(fluid1),Δt⌋ determined from the equation (6) are plotted at λ[(fluid1),Δt]=Φ($Q_1$(t)) graph (FIG. 4). Horizontal, or X axis represents the values of 1 g $Q_1$(t), the vertical, or Y axis represents the values of 1 g λ[(fluid1),Δt].

After the first 40 values are received, an approximation of pixel array received is made. The correlation dependence λ[(fluid1),Δt]=($Q_1$(t)) is the following:

$$\lambda\lfloor(\text{fluid1}),\Delta t\rfloor=0.61873*Q_1^{-0.4475}.$$

As the new data become available, at a later time the parameters of functional dependence $U_1=U_1(G_1)$ practically have not been changed.

The gelling agent (a water solution of "Kometa" copolymer and "DEG" resin, forming a system of apparent viscosity) flow resistance in tubing coefficient is calculated for every gaging of $Q_1$(t) flow rate by the correlation dependence λ[(fluid1),Δt]=$0.61873*Q_1^{-0.4475}$ in real time of the process:

Basing on the data obtained, $P_{TP}$(t) pressure losses due to gelling agent friction in tubing are calculated for every $Q_1$(t) flow rate gaging in real time of the process. So, when the flow rate $Q_1$(t)=829.44 $m^3$/day, pressure losses due to gelling agent friction in tubing equal to:

$$P_{TP}(t = 1150 \text{ s}) = 0.10858*10^{-15}*\lambda[(^{fluid}\alpha),\Delta t]*\frac{\rho_{YCT}(^{fluid}\alpha)*L*Q_\alpha^2(t)}{d_{HKT}^5} = 0.10858*10^{-15}*0.03057*\frac{1000*2230*829.44^2}{0.059^5} = 7.124$$

MPa, where

λ[(fluid1),Δt]—gelling agent flow resistance tubing coefficient when the flow rate is 829.44 $m^3$/day;

$$\lambda[(\text{fluid1}),\Delta t]=0.61873*Q_1^{-0.4475}=0.61873*829.44^{-0.4475}==0.03057;$$

L=2230 m—length of tubing from wellhead to tubing string shoe.

Then, $P_C$(t) flowing bottomhole pressure at the current time t=1150 s when the flow rate is 829.44 $m^3$/day equal to:

$$P_C(t)=P_{YCT}(t)+P_\Gamma(t)-P_{TP}(t)=13.614+21.876-7.124=28.366 \text{ MPa};$$

(by formula (9))

where:

$P_{YCT}$(t)=13.614 MPa—bottom-hole pressure at t=1150 s of the gelling agent injection when the flow rate $Q_1$(t) =829.44 $m^3$/day;

$P_\Gamma$(t)=21.876 MPa—liquid head, $P_{TP}$(t)=7.124 MPa—pressure losses due to the gelling agent friction in tubing when the flow rate $Q_1$(t) =829.44 $m^3$/day.

Hence, repression to formation $\Delta P_C$(t) at time of gelling agent injection t=1150 s when the flow rate $Q_1$(t)=829.44 $m^3$/day equals to:

$$\Delta P_C(t)=P_C(t)-P_{\Pi\Lambda I}=28.366-14.952=14.414 \text{ MPa}$$

(by formula 10)

where $P_{\Pi\Lambda I}$=14.952 MPa

MPa—formation pressure, reduced to the depth L=2230 m of tubing string shoe.

Example 2

A Measuring Section is Set on Injection Line in Front of the Wellhead, as in Example 1

When the well is operated, the well bottom zone is treated at the depth of 2230 m with the aim of water shutoff.

Well treatment includes an injection of some portions of the gelling agent (α=1) into the well bottom zone and its depression by formation water (α=2 ). A water solution of <<Kometa>> copolymer and <<DEG>> resin is used as a gelling agent and forms a system of apparent viscosity. An initial flow rate of injection is 5.3l/s.

Impulsive non-stationary agent injection is characterized by substantial variability of flow rate and pressure with random changes in amplitude and frequency. The amplitude of flow rate can be changed from 0.084 to 13.6 l/s, frequency—from 0.002 to 0.02 hertz. The amplitude of the wellhead injection pressure may change from 1 to 10÷15 MPa at the same frequency.

A value determined by the results of short-time impulsive non-stationary injectivity testing of the given well is used as a current conductivity. Preliminary tests of the given well showed that the current in-place permeability k is 0.163 $mkm^2$, conductivity k*h equals to 2.45 $mkm^2$*m, coefficient of skin-effect evaluated as 12.89. Viscosity of formation water is 1.02 mPa*s, thus, $\epsilon$ water permeability of bed is determined by the formula (19) and equals to:

$$\varepsilon = \frac{2.45}{1.02} = 2.4\ \mathrm{mkm}^2 * \mathrm{m}/(\mathrm{mPa} * s) = 2.4 * 10^{-9} \mathrm{m}^{2*}\mathrm{m}/(\mathrm{Pa} * \mathrm{s}).$$

Piezoconductivity of x formation is 0.05 $m^2/s$, radius of well $r_c$ equals to 0.084 m.

Well treatment includes an injection of some portions of gelling agent into the well bottom zone and its depression by formation water. In this case, the wellhead pressure, density and volume flow rate of the fluids injected are measured and recorded at 5 s period of scanning. $P_{TP}(t)$ pressure losses due to fluid friction in tubing, $P_T(t)$liquid head, $P_C(t)$ bottom-hole pressure (formula 9), $\Delta P_C(t)$ repression to the formation (formula 10), Q(t) volume flow rate in bottom-hole conditions are calculated on these data for every measurement in real time of the process. Next is a determination of $Y(t_N)$ repression function value (formula 11) for every N gaging (at $t_N$ time). Stored volume of agent W entered the formation to that time is determined by formula 13.

Y and W obtained values are plotted (FIG. 5).

An approximation of separate sections of Y=Y(W) graph obtained is made by straight sections in real time, determining the straight sections' slope. The first section corresponds to the injection in well bottom zone of 6.7 $m^3$ gelling agent, in this case its slope $B_1$ is:

$$B_1 = 1167.9\ \mathrm{MPa*s/m^3} = 1167.9*10^6 \mathrm{Pa*s/m^3},$$

and coefficient of skin-effect $S_1$ is determined by formula (15):

$$S_1 = 2*3.1416*2.4*10^{-9}*1167.9*10^6 - 0.5*\ln\frac{2.246*0.05}{0.084^2} = 16.228.$$

This value shows that the conductivity of a well bottom zone has been reduced a little as a result of 6.7 $m^3$ gelling agent injection. During the further agent injection the slope of the second straight section approximating Y=Y(W) curve in the range $6.8 \leqq W \leqq 8.0$ $m^3$ has increased:

$$B_2 = 1{,}988.7\ \mathrm{MPa*s/m^3} = 1{,}988.7*10^6\ \mathrm{Pa*s/m^3}.$$

The value of $S_2$ skin-effect coefficient corresponding to the second section having slope $1{,}988.7*10^6$ $Pa*s/m^3$, equals to $S_2$=28.605.

The value obtained indicates a sealing of a well bottom zone up to the project value of 28–30. In connection with this, after a 8.0 $m^3$ gelling agent is injected in bed, its injection in tubing is stopped and the injection of squeezing fluid is started.

This can be illustrated with sections 3 and 4 having practically coincident slopes 1,958.8 and 2,022.2 MPa* $S/m^3$ shown at Y=Y(W) graph (FIG. 5). The section 3 indicates a gelling agent squeezing from tubing to a well bottom zone by squeezing fluid (formation water). Coefficient of skin-effect $S_3$ at this section equals to 28.154. Hence, a project reduction of well bottom zone conductivity is achieved, there is no subsequent well bottom zone sealing and the gelling agent was injected correctly. This can be confirmed by the coefficient of skin-effect at the 4 section: $S_4$=29.11 corresponding to the rated index.

Hydrodynamic testing was not conducted directly before a water shutoff Because of this, a value of conductivity of bed obtained by previously made hydrodynamic testing was used:

k*h=4.59 $mkm^2$*m. Viscosity of agent injected was 15 mPa*s.

As a result, the known methods showed that the well bottom zone is not sealed and the skin-effect coefficient is in the range [−0,5−−0,15].

Example 3

A Measuring Section is Set on Injection Line in Front of the Wellhead, as in Example 1 and a Water Permeability of Bed is Determined Formation water is injected in a 2240-m producing well. To evaluate accuracy of determination of water permeability of bed by the method suggested, a preliminary well testing is conducted by the pressure recovery method. In accordance with this method, the water permeability of bed is 10.2 $mkm^2$*m/(mPa*s). So, to evaluate the accuracy of determination of water permeability of bed it is adopted:

$$\epsilon_{1CT} = 10.2\ \mathrm{mkm^2*m/(mPa*s)}.$$

Till the operation at well is conducted, a random row of values of water permeability of bed, $\epsilon_m$ is specified:

1 $mkm^2$*m/(mPa*s)$\leqq \epsilon_m \leqq$30 $mkm^2$*M/(mPa* s); a fortiori including a true value of water permeability of bed $$\epsilon_{ucm} = 10.2\ \mathrm{mkm^2*m/(mPa*s)}.$$

Determination of water permeability of bed includes a 3 $m^3$ formation water injection in bed. An initial flow rate of injection is 5.8 l/s. Impulsive non-stationary formation water injection at wellhead is characterized by a variability of flow rate from 5.2 to 6.4 l/s and frequency of 0.02 hertz, the injection pressure is changed similarly.

In this case, the wellhead pressure, density and volume flow rate of the fluids injected are measured and recorded at 5 s period of scanning. $P_{TP}(t)$ pressure losses due to the fluid friction in tubing, $P_T(t)$ liquid head, $P_C(t)$ bottom-hole pressure (formula 9), $\Delta P_C(t)$ repression to the formation (formula 10) and Q(t) volume flow rate are calculated on these data for every gaging in real time of the process. Next is a determination of $\Delta Y_m/\Delta X_m(t_N)$ derivative (formula 16) for every adopted value of $\epsilon_m$ water permeability of bed. Concurrent with $\Delta Y_m/\Delta X_m(t_N)$ calculation, a $W(t_N)$ stored volume of entered the formation fluid in bottom-hole conditions up to the $t_N$ time from the start of injection is calculated by formula (13)

The values obtained are plotted (FIG. 6), where horizontal, or X axis represents the values of $W(t_N)$ stored volume, the vertical, or Y axis represents the values of $\Delta Y_m/\Delta X_m(t_N)$ repression derived function.

$\Delta Y/\Delta X$ derivative graphs substantially depend on the adopted $\epsilon_m$ water permeability of bed. The closer $\epsilon_m$ values to the true value of $\epsilon_{ICT}$ water permeability of formation, the closer $\Delta Y/\Delta X$ derivative graphs to a line parallel to abscissa axis. Among the $\Delta Y_m/\Delta X_m(t_N)=\Delta Y_m/\Delta X_m[W(t_N)]$ graphs obtained, there are two lines which are in better conformity with the folowing condition (21), than the others:

$$\Delta Y/\Delta X[t,\epsilon_{ICT}]=\text{const.}$$

Further, $\epsilon$ value of water permeability of bed is determined by the known method of successive approximation $\epsilon=10.3$ mkm$^{2}$*m/(mPa*s), $\Delta Y/\Delta X$ derivative can be adopted as constant in the best way. Optimal fulfillment of the condition (21) is reached by digital methods with the use of apparatus of practical physics. The value providing the best fulfillment of the condition (21) is the $\epsilon$ desired value of water permeability of formation, precision of its measurement equals to 1%.

Example 4

A Measuring Section is Set on Injection Line in Front of the Wellhead, as in Example 1 and Well Bottom Zone Parameters are Determined Formation water is injected in a 2240-m producing well.

To evaluate the accuracy of well bottom zone parameters determination by the method suggested, an additional hydrodynamic well testing is conducted by pressure recovery method and hydrolistening. In this case, $\epsilon$ water permeability of bed, X piezoconductivity of bed, $X_{\Pi3\Pi}$piezoconductivity of well bottom zone, S skin-effect coefficient and $R_{529\ 3\Pi}$pollution zone are determined:

$$\epsilon=10.2\ \text{mkm}^{2}*\text{m}/(\text{mPa}*\text{s});$$

$$\epsilon_{\Pi3\Pi}=0.51\ \text{mkm}^{2}*\text{m}/(\text{mPa}*\text{s});$$

$X=1410$ sm$^2$/s; $X_{\Pi3\Pi}=70.6$ sm$^2$/s; S=569; $R_{\Pi3\Pi}=1.68$ m.

Prior to the determination of parameters of well bottom zone by the method suggested, preliminary investigations are conducted so, that water permeability of bed is adjusted. An impulsive non-stationary formation water injection in bed is conducted to do this. The obtained value of water permeability of bed coincides with the hydrodynamic investigation results. It is established that the well bottom zone is substantially polluted as well (S>20÷30). Because of this, a method suggested is implemented. In this case a reliable determination of well bottom zone parameters can be achieved by registration of the process parameters at wellhead (flow rate, fluid density and injection pressure).

To implement the method suggested, a main process of impulsive non-stationary formation water injection is conducted at wellhead. The process is characterized with a variation in flow rate from minimum values (0.58 l/s), providing stationary injection with uplift pressure at wellhead, to maximum values (5.79 l/s), providing a non-development of artificial fracturing in well bottom zone of formation. This can be achieved by fulfillment of condition (22) for maximum bottom-hole pressure in the process of formation water injeciton:

$$P_{C^{MaKc}}<30.6\ \text{MPa}$$

where $P_{C^{MaKc}}$—maximum admissible bottom-hole pressure in formation water injection, MPa.

To receive reliable results, it is necessary to inject at 10 injection modes with a sharp change of flow rate from larger to smaller and vice versa (table 1).

$\Delta\theta$ injection time is approximately evaluated by formula (23):

$$\Delta\theta \approx (0.2\div0.5)\frac{S}{\chi} \approx (0.2\div0.5)\frac{56.9}{0.141} \approx 80\div200\ \text{c},$$

Injection time is adopted as $\Delta\theta=200$ s at every mode of injection (table 1).

So, basing on the evaluations made at wellhead, the main impulsive non-stationary formation water injection is conducted at wellhead with a sharp change of flow rate from minimum to maximum and vice versa (table 1) in every 200 s so, that the curve of variable flow rate forms some step function (24) of t injection time (table 1).

In the process of injection in well, the wellhead pressure, density and volume flow rate of formation water are measured and recorded at 10 s intervals (i.e. at 10 s period of scanning). $P_{TP}(t)$, pressure losses due to fluid friction in tubing, $P_T(t)$liquid head, $P_C(t)$ bottom-hole pressure by formula (9), $\Delta P_C(t)$ repression to the formation by the formula (10), Q(t) volume flow rate in bottom-hole conditions are calculated on these data for every measurement in real time of the process.

Calculations are made subsequently for all gagings of wellhead parameters. A graph is constructed for every Z injection mode basing on the wellhead parameters gagings made, where the horizontal, or X axis represents the values of ln $\Delta t_Z$, the vertical, or Y axis represents the values of $\Psi_Z(\Delta t_Z)$ repression derived function, appropriate to the given time interval, $\Delta t_Z$.

FIG. 7 represents $\Psi_Z(\Delta t_Z)$—$\Delta t_Z$ graph characterizing a non-steady state flow of the fluid injected in a polluted well bottom zone during Z (Z=1; 2; . . . 9; 10) injection mode, subsequently for all 10 modes of impulsive non-stationary injection of formation water in an oil producing well, when well bottom zone parameters are determined by the method suggested in example 1.

Z=1; 2; . . . 9; 10–$\Psi_Z(\Delta t_Z)=\Phi(\ln \Delta t_Z)$ repression function graphs in Z mode with $Q_Z$ flow rate (table 1).

TABLE 1

| №№ of Z injection mode | $Q_z$, 1/s | $a_z$ | $b_z$ | $\epsilon_{\Pi3\Pi}$, (mkm$^{2}$* * m)/ /(mPa* * s) | $\chi_{\Pi3\Pi}$, sm$^2$/s | S m | $R_{\Pi3\Pi}$, |
|---|---|---|---|---|---|---|---|
| 1 | 5.79 | 1.501 | 10.22 | 0.476 | 65.8 | 56.1 | 1.76 |
| 2 | 0.58 | 541.9 | −91.23 | 0.479 | 66.2 | 55.9 | 1.75 |
| 3 | 4.63 | 19.408 | 8.891 | 0.478 | 66.1 | 56.7 | 1.74 |
| 4 | 1.16 | 219.9 | −30.63 | 0.475 | 65.6 | 56.8 | 1.74 |
| 5 | 5.21 | 13.47 | 8.123 | 0.466 | 65.4 | 56.7 | 1.73 |
| 6 | 0.58 | 500.2 | −83.14 | 0.467 | 64.6 | 56.8 | 1.73 |
| 7 | 5.79 | 6.939 | 9.351 | 0.468 | 64.7 | 56.8 | 1.74 |
| 8 | 1.16 | 274.6 | −40.87 | 0.475 | 65.6 | 56.8 | 1.75 |
| 9 | 5.21 | 14.43 | 7.954 | 0.475 | 65.7 | 56.8 | 1.75 |
| 10 | 0.58 | 501.5 | −83.33 | 0.466 | 64.4 | 56.9 | 1.74 |
| Average value by 10 determinations | | | | 0.472 | 65.4 | 56.6 | 1.74 |

So, each mode of the main injection from 10 modes has its own line (FIG. 7). An initial sloping straight is highlighted on every graph obtained in the interval 20 s≦$\Delta t_Z$≦140s (see example in table 1). The initial sloping straight reflects a non-steady state flow of the fluid injected in a polluted well bottom zone in the given Z mode of injection and can be described by equation of line (27) with very high correlation coefficients (0.96÷0.99).

$b_Z$ slope and $\alpha_Z$ initial section of highlighted straight in every Z injection mode can be found by the known least-squares method (table 1). After that, a water permeability of well bottom zone $\epsilon_{\Pi 3C}$ and piezoconductivity of well bottom zone of formation $X_{\Pi 3\Pi}$ are determined by formulas (28), (29):

$$\begin{aligned}
\varepsilon_{\Pi 3C} &= \frac{Q_z - Q_{z-1}}{Q_z - Q_{z-1} + 2 * b_z * Q_z} * \varepsilon \\
&= \frac{5.79 - 0}{5.79 - 0 + 2 * 10.22 * 5.79} * 10.2 * 10^{-9} \\
&= 0.476 * 10^{-9}\ \mathrm{m^{2*}m/Pa * s} \\
&= 0.476\ \mathrm{mkm^{2*}\ m/(mPa * s)};
\end{aligned}$$

$$\begin{aligned}
\chi_{\Pi 3\Pi} &= \frac{Q_z - Q_{z-1}}{Q_z - Q_{z-1} + 2 * b_z * Q_z} * \chi \\
&= \frac{5.79 - 0}{5.79 - 0 + 2 * 10.22 * 5.79} * 0.141 \\
&= 0.00658\ \mathrm{m^2/s} \\
&= 65.8\ \mathrm{sm^2/s}.
\end{aligned}$$

$\epsilon\pi 3\pi$and $X_{\Pi 3\Pi}$ are determined similarly for the other modes of injection (table 1). Using $\alpha_Z$, $b_Z$, $a_{Z-1}$, $b_{Z-1}$ coefficients obtained for two. adjacent modes of injection Z, Z−1 by the formulas (30):

$$S = \frac{a_{z-1} * b_z - a_z * b_{z-1}}{b_z - b_{z-1}} = \frac{1.501 * (-91.23) - 541.9 * 10.22}{(-91.23) - 10.22} = 55.9;$$

after that a $R_{\Pi 3\Pi}$ radius of pollution zone is calculated by formula (31):

$$\begin{aligned}
R_{\Pi 3\Pi} &= 1.5 * \sqrt{\chi_{\Pi 3\Pi} * \exp\left(\frac{S - a_z}{b_z}\right)} \\
&= 1.5 * \sqrt{0.00662 * \exp\left(\frac{55.9 - 541.9}{-91.23}\right)} \\
&= 1.75\ \mathrm{m}
\end{aligned}$$

S and $R_{\Pi 3\Pi}$ are calculated in a similar way for the rest modes of injection.

You can see the results of well bottom zone parameters determinations at 10 injection modes in table 1. Here you can find the average values of parameters.

If we compare the results of the method suggested with the results of hydrodynamic investigations of well by the known method of pressure recovery, it becomes obvious that the accuracy of the method suggested is rather sufficient for its use in oil-field practice. The method considred has the following precision of determination:

water permeability and piezoconductivity of well bottom zone—7.4%;

skin-effect coefficient—5.6%;

radius of polluted zone—3.6%.

Application of the method suggested will allow increasing in accuracy of treatment effectiveness evaluation.

The invention claimed is:

1. A method of well, well bottom zone and bed characteristics determination including installing on an injection line in front of a wellhead a measuring section in the form of a calibrated pipe of a length allowing fixing pressure drops when liquids with minimum hydraulic friction flow, the section being provided with assembled flow sensors and pressure sensors and a differential manometer with impulsive pipes connected with a beginning and an end of the measuring section; impulsive non-stationary injection of a reagent; measuring at the wellhead pressure, consumption and pressure drops during injection of a working agent into the well; after which, recalculating measurement data to bottom hole conditions; determining a stored flow rate and work required for a non-steady state flow of an agent consumption unit in the well bottom zone; calculating skin effect co-efficient by these figures taking into account of current conductivity of the bed, the latter being determined by the results of a short-term impulsive non-stationary well intake capacity testing with a bed fluid; changing agent injection mode, when the well bottom zone filtration characteristics required and determined by the skin effect calculated by the stored flow rate and the agent flow consumption unit work in the well bottom zone are achieved, taking into account of the current conductivity of the bed, wherein, for each measurement under conditions of impulsive non-stationary injection of the bed fluid during each injection mode, the repression function is determined, said function characterizing non-steady state flow in the well bottom zone during a fluid injection mode, plotting for each mode a graph of repression function vs. injection time logarithm in this mode, highlighting initial sloping straights, finding parameters of said highlighted straights by the least-squares method, by which it is possible to determine water permeability and piezoconductivity of polluted bottom hole formation zone as well as its radius and skin-effect co-efficient.

2. A method of well, well bottom zone and bed characteristics determination including installing on an injection line in front of a wellhead a measuring section in the form of a calibrated pipe of a length allowing fixing pressure drops when liquids with minimum hydraulic friction flow, the section being provided with assembled flow sensors and pressure sensors and a differential manometer with impulsive pipes connected with a beginning and an end of the measuring section; impulsive non-stationary injection of a reagent; measuring at the wellhead pressure, consumption and pressure drops during injection of a working agent into the well; after which, recalculating measurement data to bottom hole conditions; determining a stored flow rate and work required for a non-steady state flow of an agent consumption unit in the well bottom zone; calculating skin effect co-efficient by these figures taking into account of current conductivity of the bed, the latter being determined by the results of a short-term impulsive non-stationary well intake capacity testing with a bed fluid; changing agent injection mode, when the well bottom zone filtration characteristics required and determined by the skin effect calculated by the stored flow rate and the agent flow consumption unit work in the well bottom zone are achieved, taking into account of the current conductivity of the bed, wherein the stored flow rate and repression function derivative are determined, said function characterizing the work required for a non-steady state flow of formation of bed fluid consumption unit, plotting a graph of a repression function derived vs. stored flow rate for the bed fluid permeability range, a fortiori including producing formation water permeability, selecting among a plurality of curves of derived line one, which is in the closest conformity with the derived function constancy condition and by which water permeability of producing formation is determined.

3. A device for well, well bottom zone and bed characteristics determination, including a pressure sensor and flow sensors connected with a device for recording the medium parameters, wherein the device is provided with a differential manometer with impulsive pipes, secondary flow meters blocks and a measuring section set mounted on injection line in front of the wellhead; the measuring section being of length allowing fixing pressure drops as fluid media of minimum hydraulic friction flows; the section being in the form of a calibrated pipe with assembled flow sensors, a differential manometer with impulsive pipes connected with a start and an end of the measuring section and a pressure sensor; the device for recording medium parameters being a kind of remote block and locates spark protection blocks and an information collection block connected with a computer; wherein flow sensors outlets are connected to inlets of information collection block through secondary flow meters blocks; other inlets of information collection block being connected with the pressure sensor and differential manometer outlets through the spark protection blocks of the remote block.

4. The device according to claim 3 wherein it additionally locates density and temperature sensors at the measuring section.

* * * * *